US005921512A

United States Patent [19]

Torres

[11] Patent Number: 5,921,512

[45] Date of Patent: Jul. 13, 1999

[54] BAG BACK FOR THERMOPLASTIC BAGS AND LIQUID-DISPENSING RACK ATTACHMENT FOR WETTING THE FINGERS OF A USER

[76] Inventor: Jeffrey S. Torres, 3218 Nedmore Ct., Matthews, N.C. 28105

[21] Appl. No.: 09/067,442

[22] Filed: Apr. 28, 1998

[51] Int. Cl.[6] ..... B65B 67/04

[52] U.S. Cl. ..... 248/99; 222/192

[58] Field of Search ..... 248/95, 97, 99, 248/100; 222/192, 559

[56] References Cited

U.S. PATENT DOCUMENTS 4,212,332 7/1980 Kutick et al. ..... 222/192 X
4,458,867 7/1984 Malik ..... 248/97
4,953,815 9/1990 Beymer et al. .
5,020,750 6/1991 Vrooman et al. ..... 248/97
5,564,605 10/1996 Heidbreder ..... 222/192

*Primary Examiner*—Ramon O. Ramirez
*Attorney, Agent, or Firm*—Adams Law Firm, P.A.

[57] ABSTRACT

A bag rack for holding flexible thermoplastic bags includes a base and an upstanding support frame with the base. A bag carrier is attached to the frame and is adapted for extending through respective aligned openings in the bags for carrying the bags on the rack. A liquid container is attached to the frame, and includes a dispenser assembly for dispending a controlled amount of liquid on the fingers of a user to facilitate individual removal of the bags from the bag carrier.

12 Claims, 4 Drawing Sheets

BAG BACK FOR THERMOPLASTIC BAGS AND LIQUID-DISPENSING RACK ATTACHMENT FOR WETTING THE FINGERS OF A USER

TECHNICAL FIELD AND BACKGROUND OF THE INVENTION

This invention relates generally to a bag rack for holding a stack of thermoplastic bags, such as "T-shirt" grocery bags, and more particularly to a rack attachment used to periodically wet the fingers of a user. The bags are held generally vertically on the rack in a flat condition, and are removed one at a time and opened for loading with grocery items and the like. Because of the thermoplastic construction of the bag, it is generally difficult for workers with dry fingers to quickly remove a single bag from the stack and open it.

In an effort to combat this problem, some grocery workers place a wet sponge on or near the bag rack and squeeze it to moisten their fingers prior to pulling a bag from the rack. The sponge, however, dries quickly and is generally inconvenient to re-wet and store. Furthermore, any spillage of water on the floor in an area of the bag rack creates a safety hazard to the worker and customers. Other workers lick their fingers prior to pulling a bag from the rack. This is not only unappealing to the customer, but may also promote the spread of germs to customers and other grocery workers.

The present invention addresses these and other problems by providing a bag rack with a liquid-dispensing attachment applicable for readily and conveniently wetting the fingers of a user. The invention contains the liquid without risk of spillage and without requiring frequent refill. Moreover, the invention is relatively inexpensive and conveniently retrofitted to any conventional wire bag rack.

SUMMARY OF THE INVENTION

Therefore, it is an object of the invention to provide a bag rack including a liquid-dispensing attachment containing a liquid, such as water, for wetting the fingers of a user.

It is another object of the invention to provide a bag rack including a liquid-dispensing attachment which will not spill.

It is another object of the invention to provide a liquid-dispensing bag rack attachment which is readily retrofitted onto any conventional bag rack.

It is another object of the invention to provide a bag rack including a liquid-dispensing attachment which dispenses a controlled amount of liquid onto the fingers of a user when touched by the user.

It is another object of the invention to provide a bag rack including a liquid-dispensing attachment which is relatively inexpensive to manufacture.

It is another object of the invention to provide a bag rack including a liquid-dispensing attachment which does not require frequent refilling.

These and other objects of the present invention are achieved in the preferred embodiments disclosed below by providing a bag rack for holding a stack of flexible thermoplastic bags. The bag rack includes a base and an upstanding support frame formed with the base. A bag carrier is attached to the frame and is adapted for extending through respective aligned openings in the bags for carrying the bags on the rack. A liquid container is attached to the frame, and includes a dispenser assembly for dispensing a controlled amount of liquid on the fingers of a user to facilitate individual removal of the bags from bag carrier.

According to one preferred embodiment of the invention, the frame includes first and second spaced-apart vertical frame members integrally formed with the base, and a horizontal frame member integrally formed with the first and second vertical frame members.

According to another preferred embodiment of the invention, the bag carrier includes an arcuate head attached to the horizontal frame member and adapted for extending through respective aligned top center openings formed in the bags.

According to yet another preferred embodiment of the invention, the bag carrier includes first and second laterally spaced support arms secured to the frame and adapted for extending through respective aligned side openings formed in the bags.

According to yet another preferred embodiment of the invention, the container includes a top opening for filling and draining liquid, and a cap for removably covering the opening.

According to yet another preferred embodiment of the invention, the dispenser assembly includes a body portion attached adjacent a bottom opening in the container, an elongate hollow tube connected to the body portion, and a ball valve for regulating the flow of liquid outwardly from the tube when touched by the user.

According to yet another preferred embodiment of the invention, first and second vertical mounting legs depend from the container for mounting the container to the frame.

According to yet another preferred embodiment of the invention, first and second spaced-apart side rails are attached to the frame, and adapted for residing on opposite sides of the stacked bags.

A liquid-dispensing attachment is further provided for use in combination with a bag rack adapted for holding a stack of flexible thermoplastic bags. The attachment includes a liquid container including a dispenser assembly for dispensing a controlled amount of liquid on the fingers of a user to facilitate individual removal of the bags from the rack.

A method according to one embodiment of the invention includes the steps of touching a liquid dispenser assembly attached to the bag rack to dispense a controlled amount of liquid on the fingers. Then, with the fingers moistened, the user grips a single bag in the stack and removes it from the rack.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
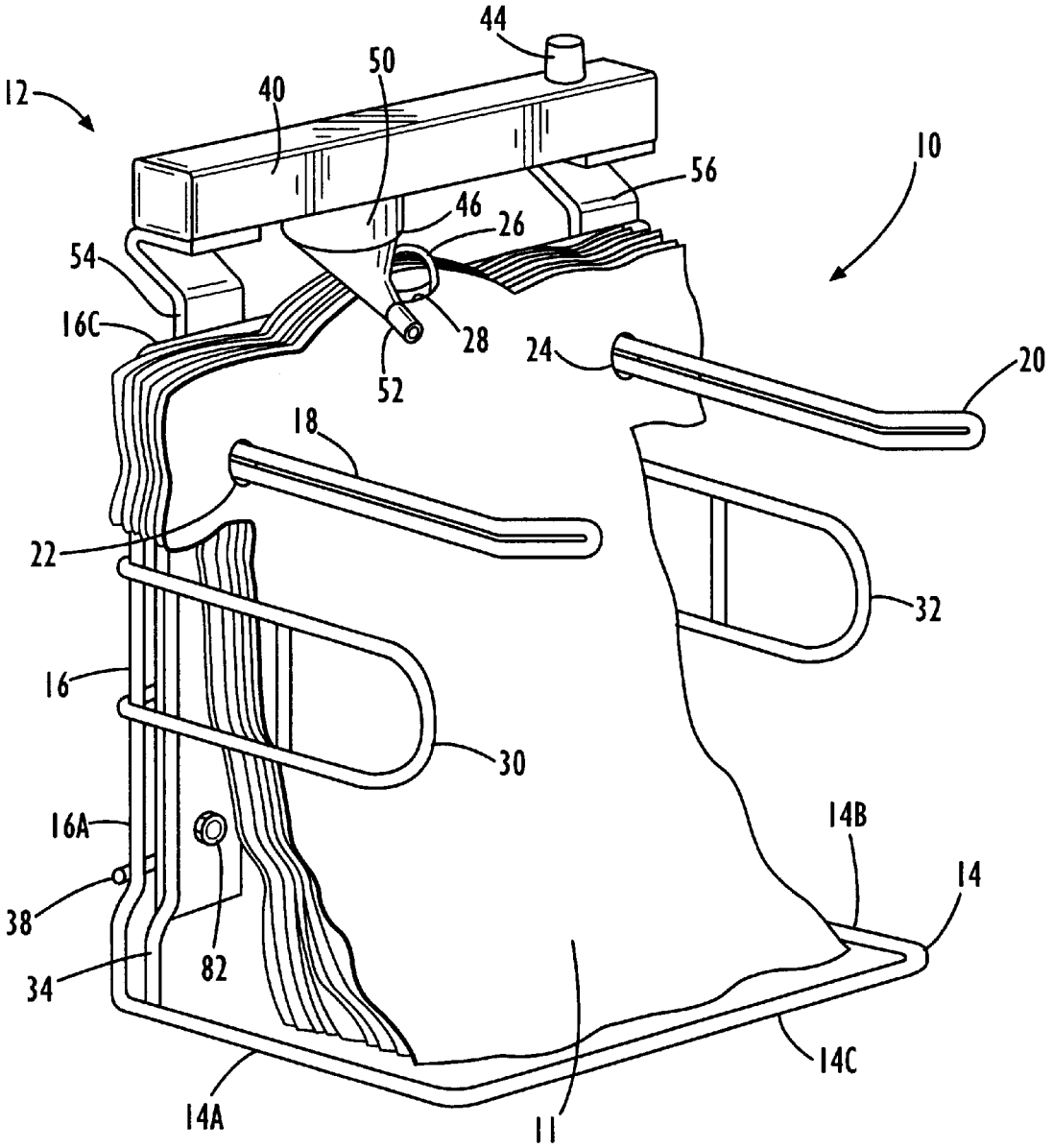
FIG. 1 is a perspective view of a bag rack including a liquid-dispensing rack attachment according to one preferred embodiment of the present invention.

Referring now specifically to the drawings, a wire bag rack according to the present invention is illustrated in FIG.

1 and shown generally at reference numeral 10. The bag rack 10 is adapted for holding a stack of flexible thermoplastic bags 11, and includes a liquid-dispensing rack attachment 12 for containing and dispensing liquid to wet the fingers of a user to facilitate quick removal of the bags 11 individually from the rack 10. The plastic bags 11 shown are commonly referred to as "T-shirt" bags. The bag rack 10 has particular application in grocery stores and convenience stores where workers are generally expected to bag purchased items in a fast and efficient manner.

Figure 2:
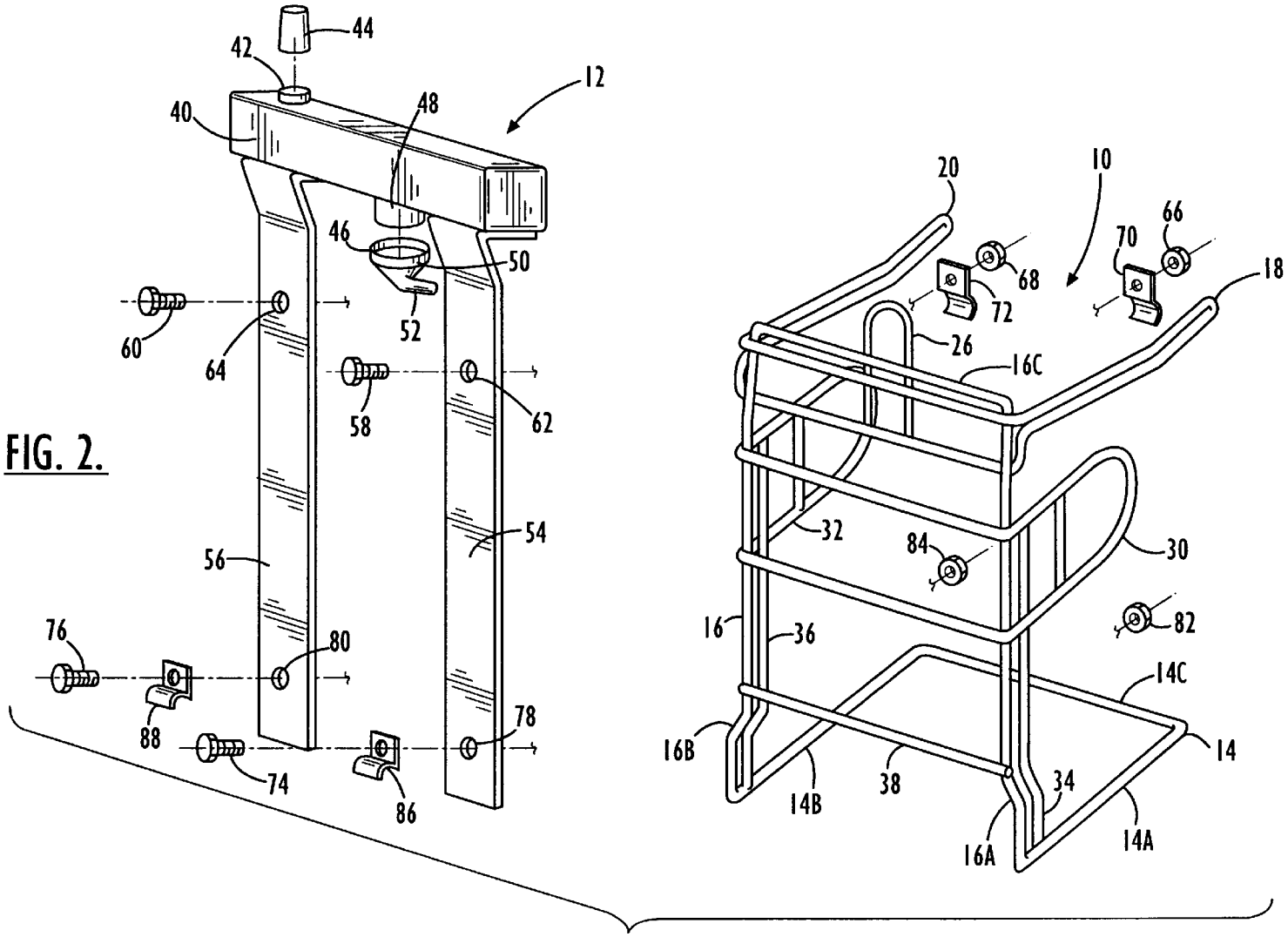
FIG. 2 is an exploded perspective view of the liquid-dispensing attachment and bag rack.

As best shown in FIGS. 1 and 2, the bag rack 10 has a base 14 and an upstanding rear support frame 16 formed with the base 14. The base 14 includes integral base members 14A, 14B, and 14C. The support frame 16 includes spaced vertical frame members 16A and 16B formed with base members 14A and 14B, and a top horizontal frame member 16C formed with the vertical members 16A and 16B. Integrally-formed support arms 18 and 20 are welded to a top end of the frame 16, and extend through respective aligned openings 22 and 24 formed in opposite sides of the bags 11 to support the bags 11 vertically in the rack 10. An arcuate wire head 26 is attached to the top horizontal frame member 16C and extends through respective aligned center openings 28 in the bags 11.

According to one embodiment, the rack 10 further includes integral side rails 30 and 32 attached to the vertical frame members 16A and 16B below the support arms 18 and 20, and including respective vertical rail members 34 and 36 attached to the base members 14A and 14B. The side rails 30 and 32 cooperate to maintain the bags 11 in overlying vertically-disposed registration on the rack 10. A bottom horizontal frame member 38 is attached the vertical frame members 16A and 16B to provide added stability.

The rack attachment 12 includes a container 40 for holding a liquid, such as water, and a top opening 42 for filling and draining the container 40. A removable cap 44 covers the top opening 42. A dispenser assembly 46 fits over a bottom opening 48 in the container 40, and includes a cylindrical body portion 50 and an elongate dispensing tube 52. The bottom opening 48 and body portion 50 have complementary screw threads for securing the dispenser assembly 46 to the container 40.

A pair of flat bar mounting legs 54 and 56 depend from the container 40 and attach to the frame 16. Threaded bolts 58 and 60 extend through openings 62 and 64 formed in the legs 54 and 56, and cooperate with nuts 66 and 68 and clips 70 and 72 to hold an upper portion of the rack attachment 12 to the top horizontal frame member 16C. Threaded bolts 74 and 76 extend through a lower set of openings 78 and 80, and cooperate with nuts 82 and 84 and clips 86 and 88 to hold a lower portion of the rack attachment 12 on the bottom horizontal frame member 38.

Figure 3:
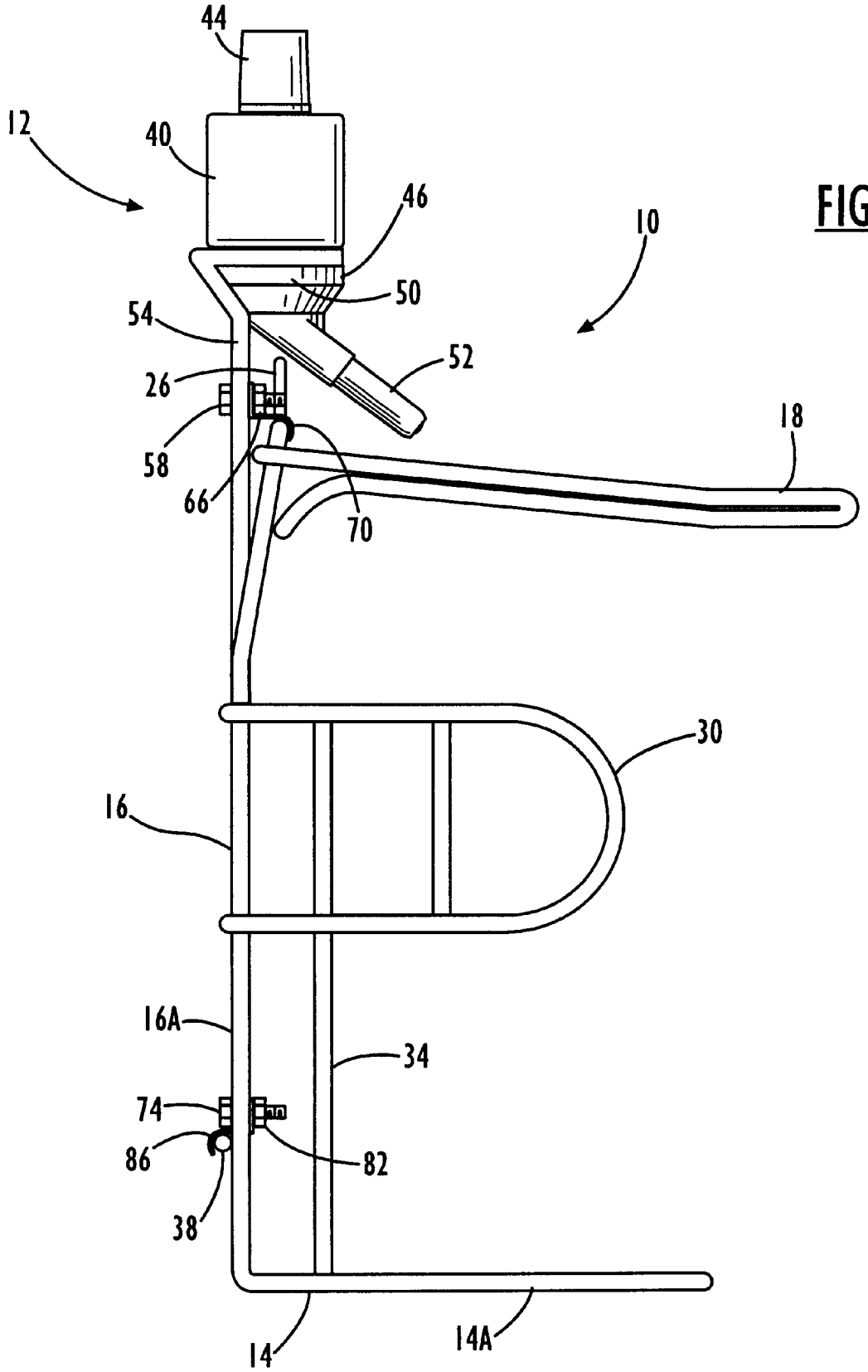
FIG. 3 is a side elevational view of the liquid-dispensing attachment and bag rack.

As best shown in FIG. 3, the mounting legs 54 and 56 position the container 40 and dispenser assembly 46 above the frame 16 and proximate the wire head 26. The dispensing tube 52 projects outwardly away from the container 40 and wire head 26 for convenient, unobstructed access by the user.

Figure 4:
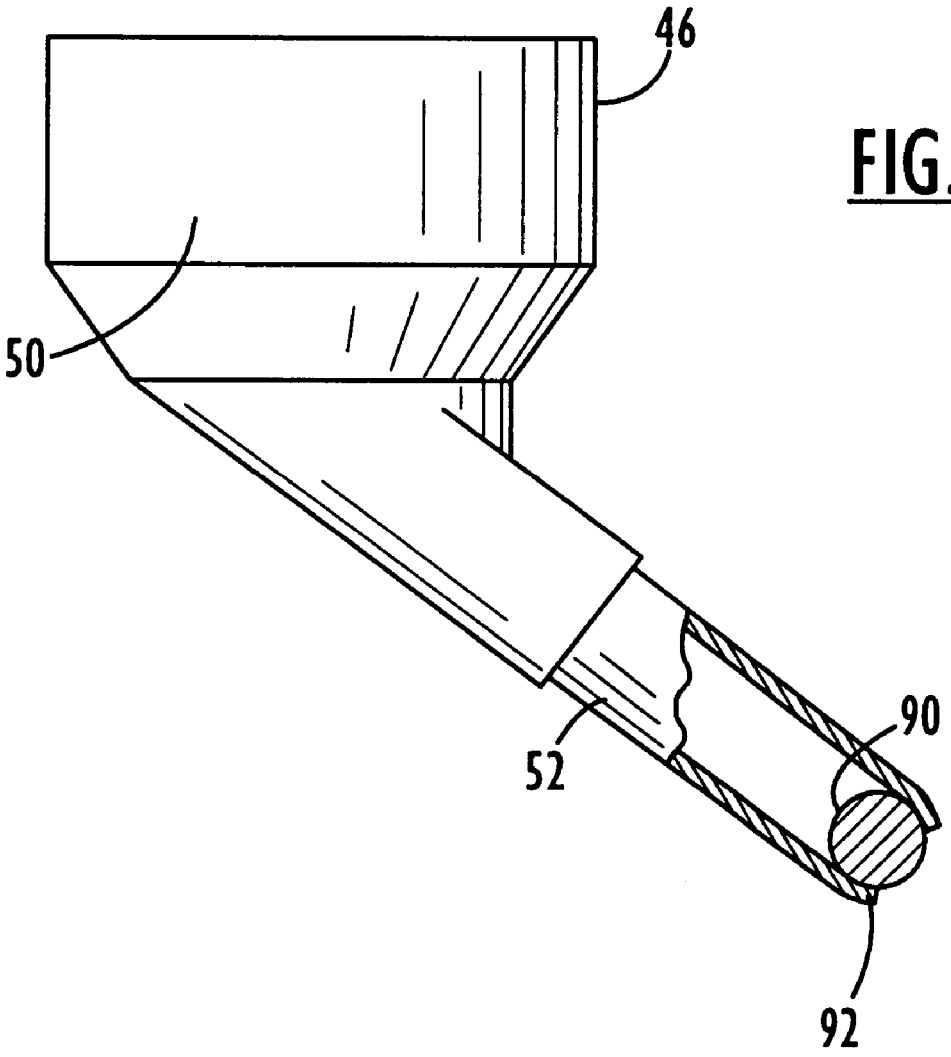
FIG. 4 is a side elevational view of the dispenser assembly with a portion of the dispensing tube broken away to show the ball valve.

As shown in FIG. 4, the dispensing tube 52 has a ball valve which regulates the dripping of water outwardly through its open end. The ball 90 is normally urged by the water pressure against an annular shoulder 92 formed at the open end of the tube 52 to seal the tube 52 when not in use. The user wets his fingers by touching the open end of the dispensing tube 52 and moving the ball 90 out of sealing engagement with the annular shoulder 92 to release a small amount of water. With the fingers moistened, the user can readily grip and pull a single bag 11 from the rack 10.

In the embodiment shown, the bags 11 are arranged in a vertically-disposed stack supported on the rack 10. The attachment 12, however, is equally applicable to those bag racks which hold bags in a generally horizontally-disposed stack.

A bag rack for holding thermoplastic bags and a rack attachment for wetting the fingers of a user are described above. Various details of the invention may be changed without departing from its scope. Furthermore, the foregoing description of the preferred embodiment of the invention and the best mode for practicing the invention are provided for the purpose of illustration only and not for the purpose of limitation-the invention being defined by the claims.

I claim:

1. A bag rack for holding a stack of flexible thermoplastic bags, comprising:

(a) a base;

(b) an upstanding support frame formed with said base;

(c) a bag carrier attached to said frame and adapted for extending through respective aligned openings in the bags for carrying the bags on the rack; and (d) a liquid container attached to said frame, and including a dispenser assembly for dispensing a controlled amount of liquid on the fingers of a user to facilitate individual removal of the bags from said bag carrier.

2. A bag rack according to claim 1, wherein said frame comprises first and second spaced-apart vertical frame members integrally formed with said base, and a horizontal frame member integrally formed with said first and second vertical frame members.

3. A bag rack according to claim 1, wherein said bag carrier comprises an arcuate head attached to the horizontal frame member and adapted for extending through respective aligned top center openings formed in the bags.

4. A bag rack according to claim 1, wherein said bag carrier comprises first and second laterally spaced support arms secured to said frame and adapted for extending through respective aligned side openings formed in the bags.

5. A bag rack according to claim 1, wherein said container includes a top opening for filling and draining liquid, and a cap for removably covering said opening.

6. A bag rack according to claim 1, wherein said dispenser assembly includes a body portion attached adjacent a bottom opening in said container, an elongate hollow tube connected to said body portion, and a ball valve for regulating the flow of liquid outwardly from said tube when touched by the user.

7. A bag rack according to claim 1, and comprising first and second vertical mounting legs depending from said container for mounting said container to said frame.

8. A bag rack according to claim 1, and comprising first and second spaced-apart side rails attached to said frame, and adapted for residing on opposite sides of the stacked bags.

9. A liquid-dispensing bag rack attachment for use in combination with a bag rack adapted for holding a stack of flexible thermoplastic bags, said attachment comprising a liquid container including a dispenser assembly for dispensing a controlled amount of liquid on the fingers of a user to facilitate individual removal of the bags from the rack, said dispenser assembly including a body portion attached adjacent a bottom opening in said container, an elongate hollow tube connected to said body portion, and a ball valve for regulating the flow of liquid outwardly from said tube when touched by the user.

10. A bag rack attachment according to claim 9, wherein said container includes a top opening for filling and draining liquid, and a cap for removably covering said opening.

11. A bag rack attachment according to claim 9, and comprising first and second vertical mounting legs depending from said container for mounting said container to the rack.

12. A method of facilitating individual removal of stacked thermoplastic bags carried on a bag rack, said method comprising the steps of:

(a) touching a liquid dispenser assembly attached to the bag rack to dispense a controlled amount of liquid on the fingers; and (b) with the fingers moistened, gripping a single bag in the stack and removing it from the rack.

* * * * *